US005865360A

United States Patent [19]

White

[11] Patent Number: 5,865,360

[45] Date of Patent: Feb. 2, 1999

[54] FASTENER DRIVING DEVICE WITH TRIGGER VALVE

[75] Inventor: Brian M. White, Riverside, R.I.

[73] Assignee: Stanley Fastening Systems, L.P., East Greenwich, R.I.

[21] Appl. No.: 985,681

[22] Filed: Dec. 5, 1997

Related U.S. Application Data

[60] Provisional application No. 60/033,243, Dec. 6, 1996.

[51] Int. Cl. [6] ..... B25C 1/04

[52] U.S. Cl. ..... 227/130; 227/8

[58] Field of Search ..... 227/130, 8; 91/308, 91/307, 309

[56] References Cited

U.S. PATENT DOCUMENTS

| | | | |
|---|---|---|---|
| 3,278,103 | 10/1966 | Juilfs | 227/130 |
| 3,427,928 | 2/1969 | Bade | 227/130 |
| 3,477,629 | 11/1969 | Becht . | |
| 3,583,496 | 6/1971 | Fehrs . | |
| 4,098,295 | 7/1978 | Haytayan . | |
| 4,480,528 | 11/1984 | Shiroyama . | |
| 4,915,013 | 4/1990 | Moraht | 91/307 |
| 5,370,037 | 12/1994 | Bauer . | |
| 5,628,444 | 5/1997 | White | 227/130 |
| 5,669,542 | 9/1997 | White | 227/8 |

*Primary Examiner*—Scott A. Smith
*Assistant Examiner*—James P. Calve
*Attorney, Agent, or Firm*—Cushman Darby & Cushman IP Group of Pillsbury Madison & Sutro LLP

[57] ABSTRACT

An improved pneumatically operated fastener driving device comprising an actuating assembly mounted with respect to a housing assembly and movable from an inoperative position to an operative position. A first sealing element is mounted with respect to a feed path. The first sealing element moves from a sealed position, wherein it prevents communication between an air pressure reservoir and a control pressure chamber when the actuating assembly is in the operative position, and an unsealed position, wherein the first sealing element permits such communication to move a main valve to a closed position when the actuating assembly is in the inoperative position. A second sealing element is mounted with respect to an exhaust port and moves from a sealed position, wherein it prevents communication between the control pressure chamber and the atmosphere when the actuating assembly is in the inoperative position, and an unsealed position, wherein the second sealing element permits such communication, thereby affecting movement of the main valve to an open position, when the actuating assembly is in the operative position. A biasing element is operatively associated with the second sealing element and biases the second sealing element towards its unsealed position to maintain communication of the control pressure chamber with the atmosphere until the first sealing element has moved to its unsealed position.

19 Claims, 6 Drawing Sheets

FASTENER DRIVING DEVICE WITH TRIGGER VALVE

This application claims the benefit of priority from provisional application serial No. 60/033,243 filed Dec. 6, 1996.

The present invention relates to fastener driving devices and, more particularly, to air operated fastener driving devices.

Fastener driving devices having an actuating member which is mounted in the housing assembly of the device so as to open a passageway to operate the device are well known. U.S. Pat. No. 5,628,444 discloses a fastener driving device having a control module which includes an actuating member with an O-ring fixed thereto. The O-ring serves to seal and unseal an exhaust port as the actuating member is engaged, thereby exhausting a pressure chamber to open a main valve and initiate a drive stroke of the piston. However, it has been found that during skid-fire conditions, the O-ring would seal-off prematurely, thereby causing the main valve to hang up and move towards a partially or fully closed position.

A skid-fire condition occurs when the driving element pushes off the fastener or work surface, causing the tool to react away from the work surface and resetting the actuating member. As the actuating member is reset, the O-ring fixed thereto seals off the exhaust port and causes the main valve to hang up and move toward a partially or fully closed position. The weight of the tool and the force applied to the tool by the user tends to resist this movement and requires some skill. In accordance with the principles of the present invention, an improved fastener driving device is provided to prevent the main valve from hanging up and moving toward a partially or fully closed position during skid-fire conditions.

Also, U.S. Pat. No. 4,915,013 discloses a fastener driving device having an actuating assembly with an upper O-ring and a lower O-ring fixed to a trigger valve. When the trigger valve is engaged and moved upwards, the upper O-ring seals off communication between a pressure reservoir and a main control chamber, and the lower O-ring leaves a associated bore of the valve plate, thereby communicating the main control chamber with the atmosphere and allowing the main valve to move to an opened position and permit pressurized air to affect a movement of the drive piston. When the trigger valve is released and moved downwards, the lower O-ring seals off communication between the main control chamber and the atmosphere, and the upper O-ring unseals and allows pressurized air from the air reservoir to communicate with the main control chamber, thereby moving the main valve to a closed position.

In the fastener device described in the '013 patent, however, the lower O-ring seals as the upper O-ring begins to unseal. In such a configuration, if the lower O-ring seals off communication between the main control chamber before the upper O-ring unseals, leaks in the upper O-ring, and the various other O-rings and sealing elements associated with the main valve, will allow a quantity of pressurized air to flow into the main control chamber and prematurely move the main valve towards a closed position, thus creating a partial main valve return.

Accordingly, the object of the present invention is to provide a fastener driving device that prevents O-rings and other sealing elements from prematurely sealing during skid-fire conditions and causing the main valve to hang up and move toward a partially or fully closed position. It is also an object of the present invention to provide a fastener driving device that prevents leakage of pressurized air through O-rings and other sealing elements utilized in the construction of the device from causing a partial main valve return.

The present invention is a pneumatically operated fastener driving device comprising a housing assembly having a housing portion defining a fastener drive track. A fastener magazine is constructed and arranged to feed successive fasteners into the drive track. A fastener driving element is mounted for movement in the fastener drive track. A drive piston is operatively associated with the fastener driving element. The drive piston and the fastener driving element are constructed and arranged to move through an operative cycle including a drive stroke, during which a fastener within the drive track is engaged and moved outwardly from the drive track into a workpiece, and a return stroke.

A cylinder is defined in the housing portion, and the drive piston is reciprocally mounted in the cylinder. An air pressure reservoir is constructed and arranged to communicate with one end of the cylinder. An exhaust passage is constructed and arranged to communicate the one end of the cylinder with the atmosphere. A main valve is mounted with respect to the housing assembly.

The main valve is constructed and arranged to move between an open position, wherein pressurized air in the air pressure reservoir communicates with the one end of the cylinder to move the drive piston in a direction to affect the drive stroke, and a closed position wherein the exhaust passage communicates the one end of the cylinder with the atmosphere to permit the drive piston to move in a direction to affect the return stroke. The main valve has a pressure area defining with a portion of the housing assembly a control pressure chamber.

A feed path communicates the air pressure reservoir with the control pressure chamber. An exhaust seal structure is constructed and arranged to close the exhaust passage when the main valve is disposed in the open position and prevent the one end of the cylinder from communicating with the atmosphere. An exhaust port is constructed and arranged to communicate the control pressure chamber with the atmosphere.

An actuating assembly is mounted with respect to the housing assembly and is constructed and arranged to move from an inoperative position to an operative position. The actuating assembly is constructed and arranged such that engaging the actuating assembly moves it from the inoperative position to the operative position. A first sealing element is mounted with respect to the feed path. The first sealing element is constructed and arranged to move from a sealed position, wherein the first sealing element prevents communication between the air pressure reservoir and the control pressure chamber when the actuating assembly is in the operative position, and an unsealed position, wherein the first sealing element permits communication between the air pressure reservoir and the control pressure chamber, thereby affecting movement of the main valve to the closed position when the actuating assembly is in the inoperative position.

The second sealing element is mounted with respect to the exhaust port. The second sealing element is constructed and arranged to move from a sealed position, wherein the second sealing element prevents communication between the control pressure chamber and the atmosphere when the actuating assembly is in the inoperative position, and an unsealed position wherein the second sealing element permits communication between the control pressure chamber and the atmosphere, thereby affecting movement of the main valve to the open position when the actuating assembly is in the operative position.

A biasing element is operatively associated with the second sealing element. The biasing element is constructed and arranged to bias the second sealing element toward the unsealed position thereof to maintain communication of the control pressure chamber with the atmosphere until the first sealing element has moved to the unsealed position thereof, thereby preventing the main valve from moving to the closed position thereof prior to the first sealing element moving to the unsealed position thereof.

Thus, the object of providing a fastener driving device that prevents O-rings and other sealing elements form prematurely sealing during skid-fire conditions and causing the main valve to hang up and move toward a partially or fully closed position has been achieved. Also, the object of providing a fastener driving device that prevents leakage of pressurized air through O-rings and other sealing elements utilized in the construction of the device from causing a partial main valve return has been achieved.

DETAILED DESCRIPTION OF THE PREFERRED EMBODIMENT OF THE INVENTION

Figure 1:
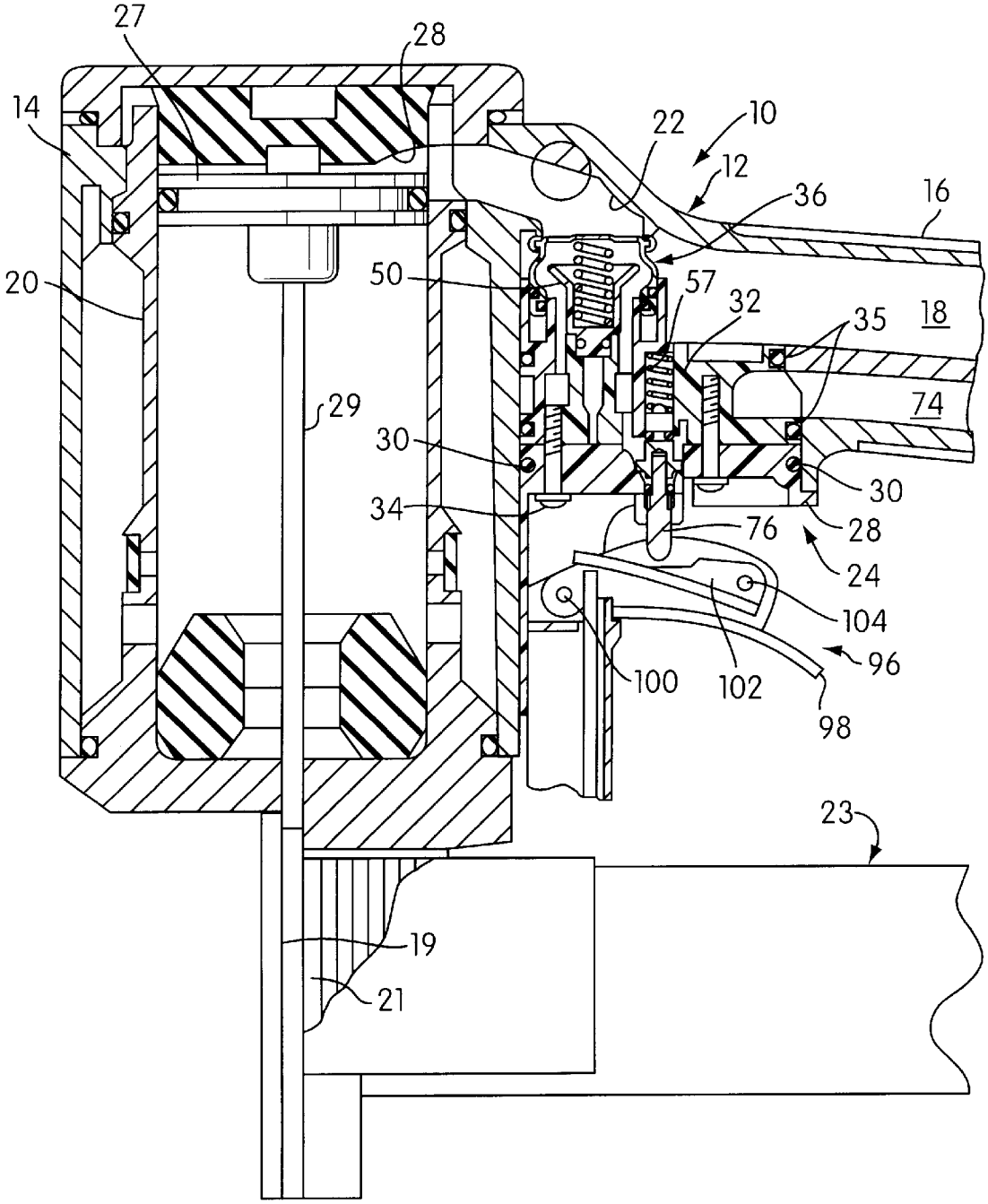
FIG. 1 is a profile view of a fastener driving device, shown partially in section, in accordance with the principles of the present invention.

Referring now more particularly to the drawings, a pneumatically operated fastener driving device, generally indicated at 10, is shown in FIG. 1, which embodies the principles of the present invention. The device 10 includes a housing, generally indicated at 12, which includes a cylindrical housing portion 14 and a main frame portion 16 extending laterally from the cylindrical housing portion 14. The main frame portion defines a hand grip portion of hollow configuration which constitutes a reservoir chamber 18 for containing air under pressure coming from a source which is communicated therewith. The cylindrical portion of the housing 12 includes the usual nose piece defining a fastener drive track 19 which is adapted to receive laterally therein the leading fastener 21 from a package of fasteners mounted within a magazine assembly, generally indicated at 23, of conventional construction and operation. Mounted within the cylindrical portion of housing 12 is a cylinder 20 which has its upper end 28 disposed in communicating relation with the reservoir chamber 18 via a passageway 22. Mounted within the cylinder 20 is a piston 27. Carried by the piston 27 is a fastener driving element 29 which is slidably mounted within the drive track 19 and movable by the piston 27 through a cycle of operation which includes a drive stroke, during which the fastener driving element 29 engages a fastener within the drive track 19 and moves the same longitudinally outwardly into a workpiece, and a return stroke.

Referring now more particularly to FIGS. 2–6, in order to effect the aforesaid cycle of operation, there is provided a control module, generally indicated at 24. The control module 24 is similar to that disclosed in U.S. Pat. No. 5,628,444, which is incorporated into the present application by reference, except for the improved actuating or trigger stem assembly, generally indicated at 26, thereof. Thus, the control module 24 includes a control module housing assembly, which, in the illustrated embodiment includes a trigger housing 28 coupled to the main frame portion 18 by pin connections at 30, and a valve housing 32 secured to the trigger housing 28 by fasteners, preferably in the form of screws 34. Housings 28 and 32 are preferably molded from plastic material. O-rings 35 seal the valve housing 32 within the main frame portion of the housing 12. It can be appreciated that the control module housing assembly can be formed as a single unit and can be easily removable from the housing 12.

The control module 24 includes a main valve 36 mounted with respect to the valve housing 32. The main valve 36 is cylindrical having an outer peripheral surface 38 and an inner peripheral surface 40. The main valve 36 is mounted with respect to the passageway 22 to be moveable between opened and closed positions to open and close the passageway 22 in the manner disclosed in the aforementioned '444 patent. The main valve 36 includes a first annular pressure area 42 and a second, opposing annular pressure area (A through C in the FIGS.).

Figure 2:
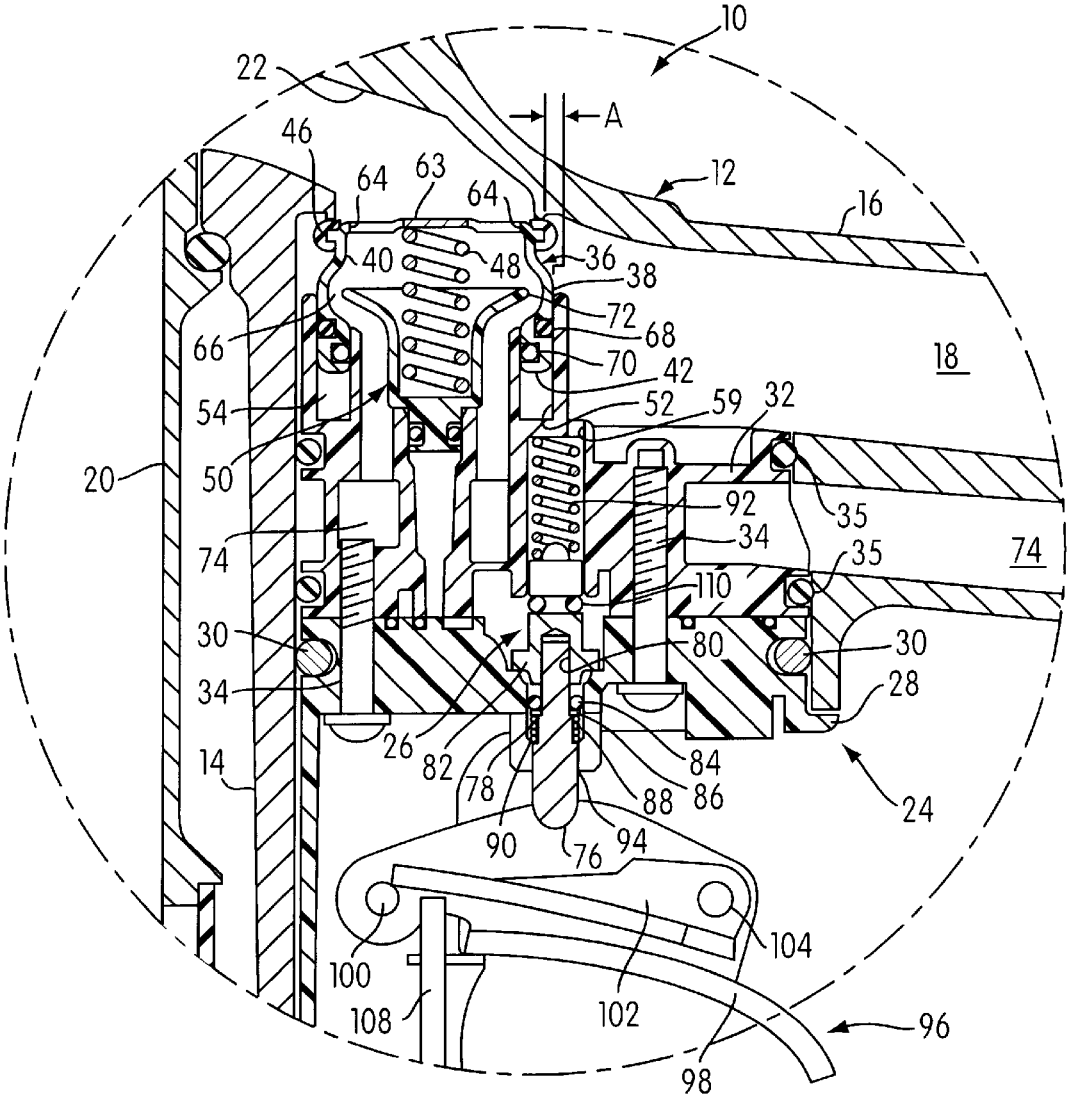
FIG. 2 is a partial view of a fastener driving device, shown partially in section, including actuating assembly provided in accordance with the principles of the present invention, shown with the device at rest.

As shown in FIG. 2, when the device 10 is at rest with the main valve 36 in its closed position, pressure area A extends beyond annular housing seating surface 46 and is exposed to reservoir pressure. A spring structure, in the form of a coil spring 48, biases the main valve 36 to its closed position together with reservoir pressure acting on pressure area 42. Thus, the force of the spring 48 plus the force acting on pressure area 42 is greater than the force due to pressure acting on the opposing pressure area A, which results in the keeping the main valve 36 in its closed position. The spring 48 is disposed between a surface of an exhaust seal structure, generally indicated at 50, and a surface of the main valve 36.

Figure 4:
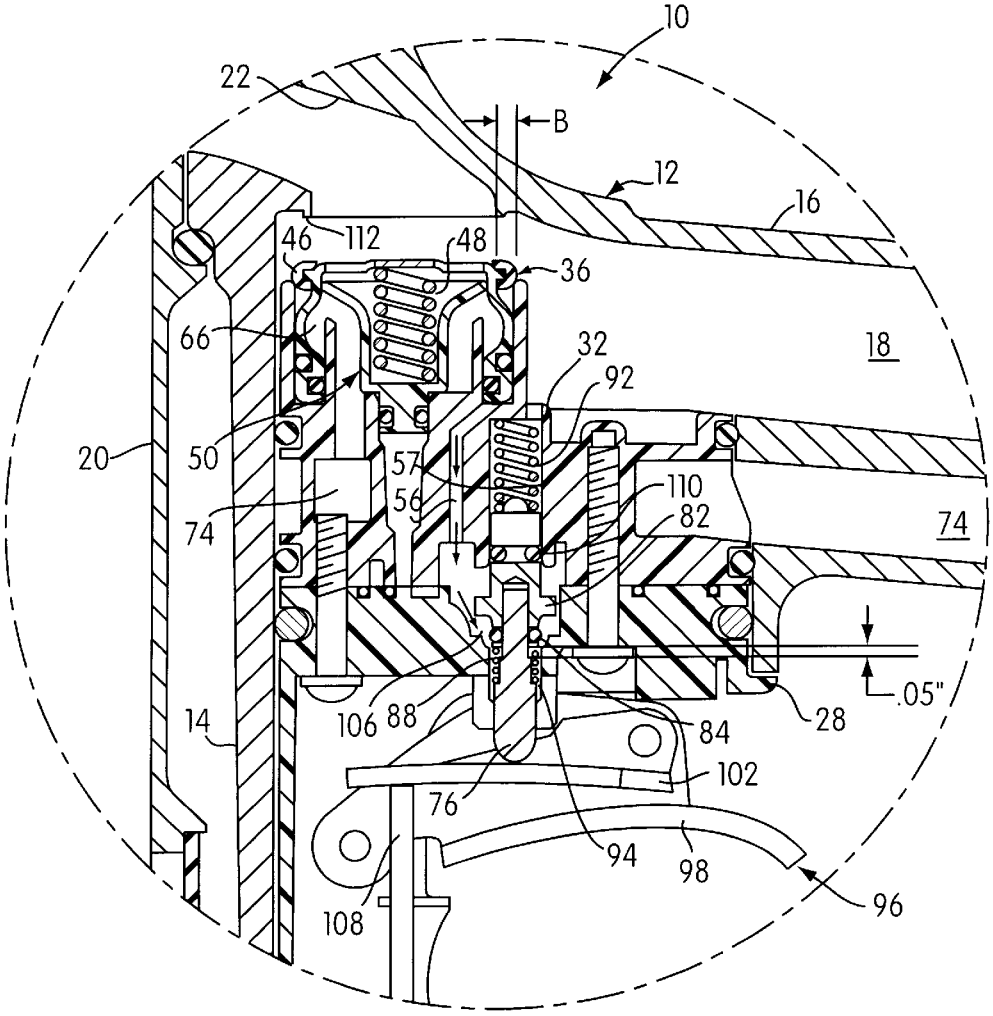
FIG. 4 is a view similar to FIG. 2, showing the main valve in an opened position.

The first pressure area 42 together with annular groove portion 52 of the valve housing 32 define a control pressure chamber 54. The pressure chamber 54 is in communication with the reservoir pressure or high pressure in chamber 18 via a main passage 56 and bore 57 (FIG. 4). Bore 57 houses an upper portion of the actuating assembly 26 and is exposed to reservoir pressure in chamber 18 via a feed path of port 59. This high pressure in chamber 54 is dumped to atmosphere to open the main valve 36, as will be explained below.

In the illustrated embodiment, the upper surface 63 of the main valve 36 includes a plurality of ports 64 therein so that the passageway 22 and thus the upper end of the cylinder 20 may communicate with an exhaust passage 66, defined in the control module housing assembly, the function of which will become apparent below. O-ring seals 68 and 70 are provided for sealing the main valve 36 within the valve housing 32.

The exhaust seal structure 50 is fixed to the valve housing 32. The seal structure 50 is disposed within an interior of the main valve 36 and includes an annular valve element 72 which engages the inner peripheral surface 40 of the main valve 36 when the main valve is in its fully opened position (FIG. 4), which closes the exhaust passage 66 and prevents the upper end of the cylinder from communicating with an exhaust path 74, as will be explained more fully below.

In accordance with the principles of the invention, the control module 24 includes the actuating assembly 26, which is carried by the module 24 for rectilinear movement from a normal, inoperative position into an operative position for initiating movement of the main valve 36 to its open position, thereby initiating movement of the fastener driving element through a fastener drive stroke.

The actuating assembly 26 includes a preferably steel, lower stem member 76 having a portion 78 which is press-fitted into a bore 80 defined in a preferably brass, upper stem member 82. A second sealing element in the form of a rubber O-ring 84 is disposed about the portion 78. The O-ring 84 rests on a brass washer 86 and a biasing element in the form of a coil spring 88 is disposed between the washer 86 and a seating surface 90 of the lower stem member 76. The actuating assembly 26 is biased to its normal, inoperative position by a spring member in the form of a coil spring 92 and reservoir pressure via port 59. As shown in FIG. 2, in the inoperative position, the lower O-ring 84 is pneumatically biased downwardly sealing an exhaust port 94.

As shown in FIG. 2, a manually operated trigger assembly, generally indicated at 96, is provided for moving the actuating assembly 26 when the contact trip 108 is depressed. The trigger assembly 96 includes a trigger 98 pivoted to the trigger housing 28 at pin 100 and a rocker arm 102 pivoted to the trigger 98 at pin 104. Thus, movement of the trigger 98 causes the rocker arm 102 to engage and move the lower stem member 76 from its sealed position to its operative, unsealed position.

Operation

The operation of the device 10 will be appreciated with reference to the FIGS. 2–6. As shown in FIG. 2, when the device 10 is at rest, spring 48 together with reservoir pressure in chamber 54 acting on pressure area 42 biases the main valve 36 to its closed position. Thus, the force created by reservoir pressure acting on pressure area 42 plus the force of the spring 48 is greater than the force created by the reservoir pressure acting on pressure area A, maintaining the main valve 36 in its closed position. Over-the-piston pressure in passageway 22 is atmospheric pressure since the exhaust passage 66 is in communication with the exhaust path 74. Exhaust path 74 communicates with atmosphere at the rear of the device 10.

Figure 3:
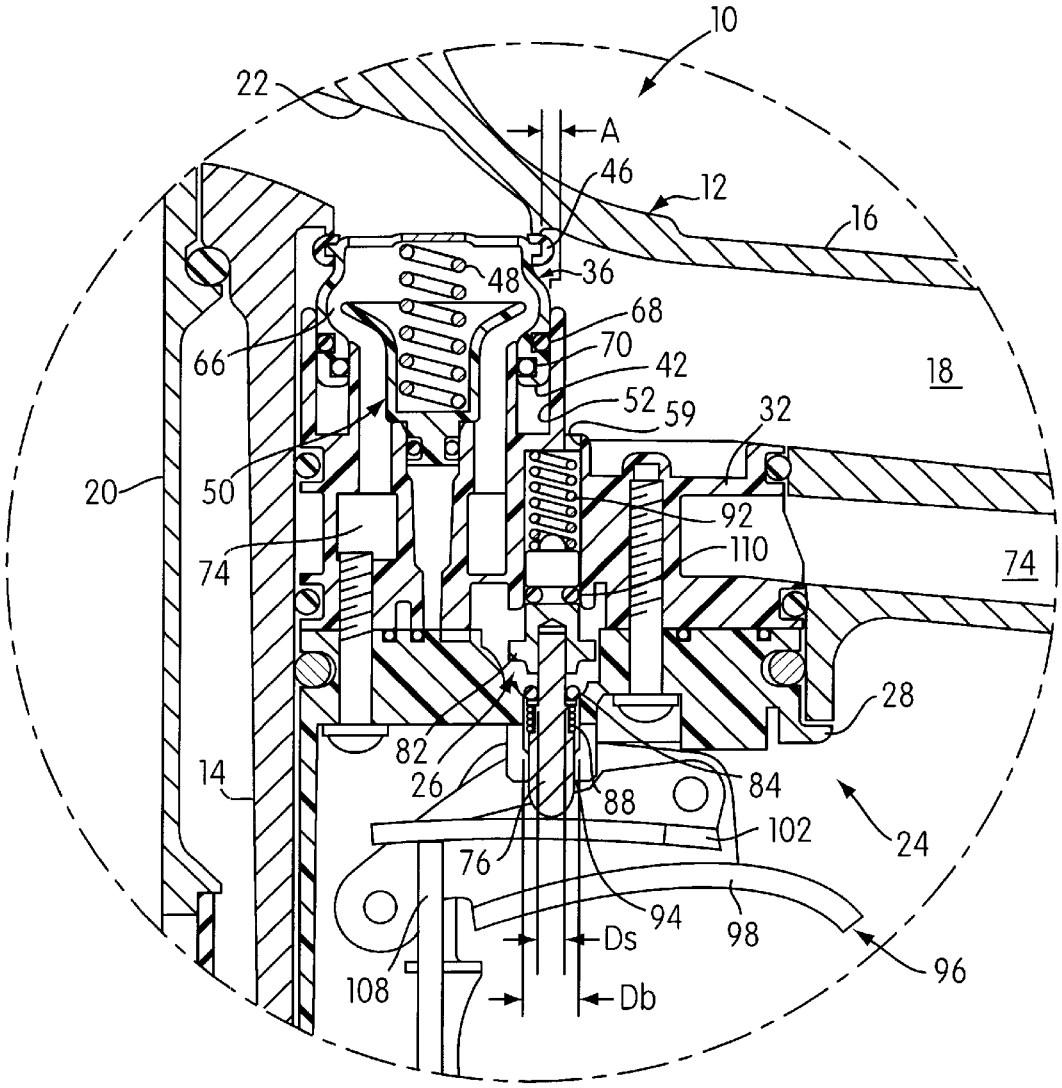
FIG. 3 is a view similar to FIG. 2, showing the initial opening of a main valve.

To initiate a fastener drive stroke typical for skid-fire sequence, the trigger 98 is pulled rotating the trigger until it contacts housing 28 (FIG. 3). The contact trip 108 is then stroked which causes the rocker arm 102 to contact the lower stem member 76 (FIG. 3). This will initially open the exhaust port 94. The lower O-ring 84 will shift to an unsealed position. When the pressure ($lb/in^2$) in the main valve chamber 54 multiplied by the stem bore area Db minus stem area Ds ($in^2$) equals the spring force P2 of spring 88, the lower O-ring 84 shifts approximately 0.05 inches to create a large pressure dump path 106 (FIG. 4). This also prevents the lower O-ring 84 from sealing-off the dump path 106 prematurely, which can occur in contact trip short stroke conditions, when inertia of the piston/fastener driving element action on the drive stroke causes the device 10 to recoil upwardly, thus shifting the actuating assembly 26 and contact trip 108 slightly downwardly. A first sealing element in the form of a rubber upper O-ring 110 isolates the reservoir pressure in chamber 18 from the dump path 106.

Thus, the above action releases high pressure air in pressure chamber 54, under the main valve 36, via main passage 56 and exhaust port 94. Initially, since pressure area 42 of the main valve 36 is exposed to low pressure air, high pressure air acting on the pressure area A overcomes the bias of spring 48 plus the low pressure air acting on area 42 and initiates movement of the main valve 36 off seating surface 112. Thereafter, the force created by reservoir pressure acting on the main valve 36 is greater than the force of the spring 48 plus the force created by the atmospheric pressure acting at pressure area 42. This accelerates movement of the main valve 36 towards its opened position. As a result, the low pressure air in passageway 22 becomes high pressure air via the reservoir chamber 18 and the high pressure air forces the main valve 36 open, thus permitting the high pressure air to communicate with the one end of the cylinder 20 to move the piston 27 in the direction to effect the drive stroke of the fastener driving device 10.

As shown in FIG. 4, when the main valve 36 is opened fully, the force created by reservoir pressure acting on pressure area B is greater than the force of the spring 48 at its compressed height plus the force created by the atmospheric pressure acting on pressure area 42. In this position, the main valve 36 engages valve element 72, thereby closing passage 66 and preventing the reservoir pressure at the upper end of the cylinder 20 from exiting the device 10 through the exhaust path 74.

Figure 5:
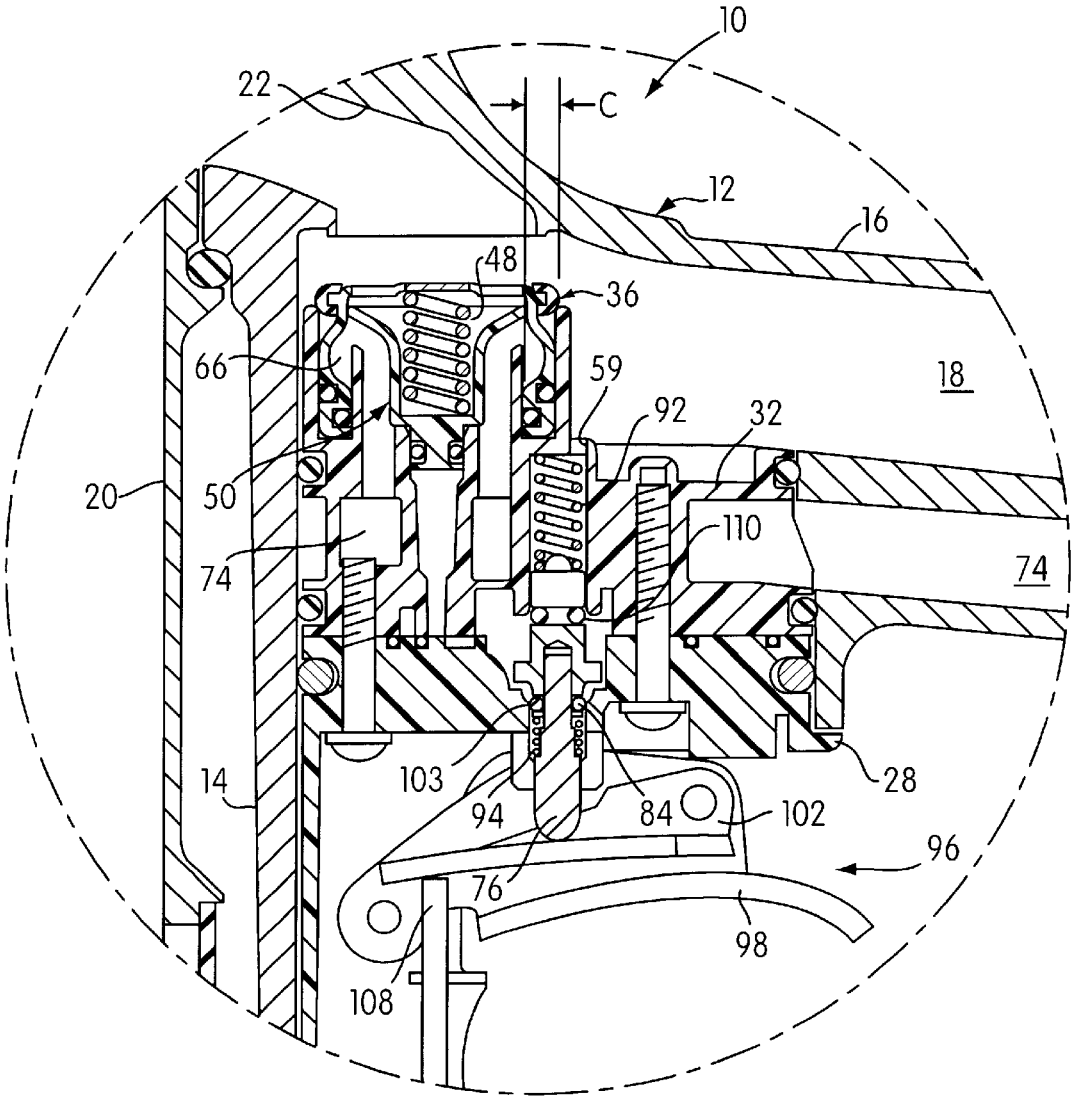
FIG. 5 is a view similar to FIG. 2, showing the initial shift of the main valve to its closed position.

With reference to FIG. 5, the upper O-ring 110 unseals when the lower O-ring 84 begins to seal-off the exhaust port 94. In addition, the upper O-ring 110 location controls the contact trip reset point. In the illustrated embodiment, the contact trip reset point is 0.11 inches from the contact trip actuation point. For a skid/bounce fire conditions, the less the reset distance is, the more enhanced the bounce fire speed becomes and the greater the reset distance is, the more the valve flutter/speed is reduced.

Thus, with the lower O-ring 84 being spring biased, the lower O-ring 84 shifts far enough from its sealing seat 103 to ensure that the main valve dump path 106 remains open until the upper O-ring 110 becomes unsealed. Furthermore, by ensuring that the lower O-ring remains unsealed until the upper O-ring 110 becomes unsealed, leakage of pressurized air through the various sealing elements utilized on the device, in particular O-rings 68, 70, and 110, is exhausted to the atmosphere through the exhaust port 94 rather than being allowed to build up in the control pressure chamber 54 and affect a premature movement of the main valve 36 towards its closed position.

Figure 6:
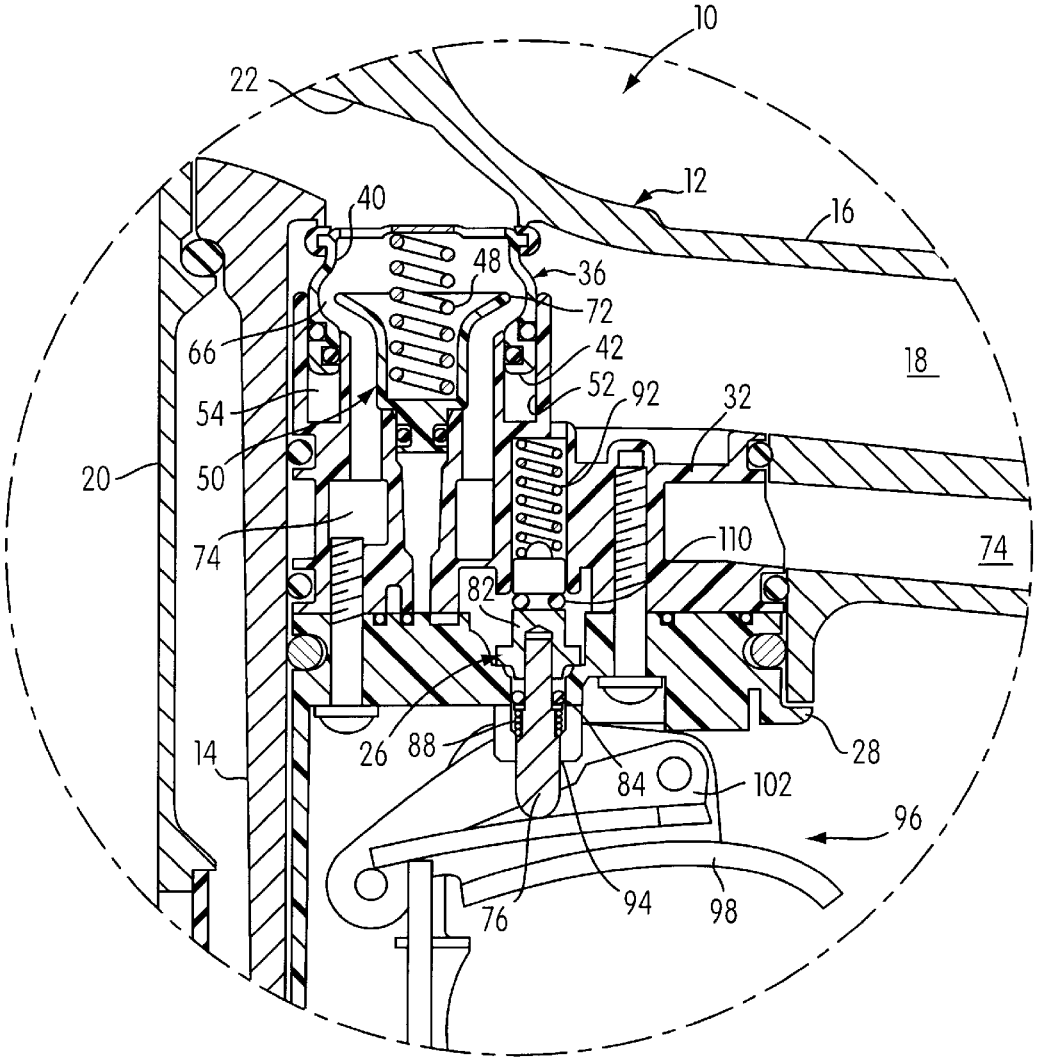
FIG. 6 is a view similar to FIG. 2, showing the main valve returned to its closed position.

FIG. 6 shows the shift of the main valve 36 to its closed position during the return stroke of the piston. Thus, when the trigger 98 is released, the lower stem member 76 moves to its sealed position unsealing the upper O-ring 110 permitting reservoir pressure to fill the pressure chamber 54 via port 59. This causes the main valve 46 to move upwardly towards its closed position, thus, completing one skid-fire cycle of the device 10.

Any United States patent applications or patents mentioned or cited hereinabove are hereby incorporated into the present specification.

It will thus be seen that the objects of the present invention have been fully and effectively accomplished. It will be realized, however, that the foregoing preferred specific embodiments have been shown and described for the purpose of illustrating the functional and structural principles of this invention and is subject to change without departure from such principles. Therefore, the present invention includes all modifications encompassed within the spirit and scope of the following claims.

I claim:

1. A pneumatically operated fastener driving device comprising:

a housing assembly having a housing portion defining a fastener drive track, a fastener magazine constructed and arranged to feed successive fasteners into said drive track, a fastener driving element mounted for movement in said fastener drive track, a drive piston operatively associated with said fastener driving element, said drive piston and said fastener driving element being constructed and arranged to move through an operative cycle including a drive stroke during which a fastener within said drive track is engaged and moved outwardly from said drive track into a workpiece and a return stroke, a cylinder defined in said housing portion, said drive piston being reciprocally mounted in said cylinder, an air pressure reservoir constructed and arranged to communicate with one end of said cylinder, an exhaust passage constructed and arranged to communicate said one end of said cylinder with the atmosphere, a main valve mounted with respect to said housing assembly and constructed and arranged to move between an opened position wherein pressurized air in said air pressure reservoir communicates with said one end of said cylinder to move said drive piston in a direction to affect said drive stroke and a closed position wherein said exhaust passage communicates said one end of said cylinder with the atmosphere to permit said drive piston to move in a direction to affect said return stroke, said main valve having a pressure area defining with a portion of said housing assembly a control pressure chamber, a feed path communicating said air pressure reservoir with said control pressure chamber, an exhaust seal structure constructed and arranged to close said exhaust passage when said main valve is disposed in said opened position and prevent said one end of said cylinder from communicating with the atmosphere, an exhaust port constructed and arranged to communicate said control pressure chamber with the atmosphere, an actuating assembly mounted with respect to said housing assembly and constructed and arranged to move from an inoperative position to an operative position, said actuating assembly being constructed and arranged such that engaging said actuating assembly moves said actuating assembly from said inoperative position thereof to said operative position thereof, a first sealing element mounted with respect to said feed path, said first sealing element being constructed and arranged to move from a sealed position, wherein said first sealing element prevents communication between said air pressure reservoir and said control pressure chamber when said actuating assembly is in said operative position, and an unsealed position, wherein said first sealing element permits communication between said air pressure reservoir and said control pressure chamber, thereby affecting movement of said main valve to said closed position, when said actuating assembly is in said inoperative position, a second sealing element mounted with respect to said exhaust port, said second sealing element being constructed and arranged to move from a sealed position, wherein said second sealing element prevents communication between said control pressure chamber and the atmosphere when said actuating assembly is in said inoperative position, and an unsealed position, wherein said second sealing element permits communication between said control pressure chamber and the atmosphere, thereby affecting movement of said main valve to said opened position, when said actuating assembly is in said operative position, and a biasing element operatively associated with said second sealing element, said biasing element being constructed and arranged to bias said second sealing element toward said unsealed position thereof to maintain communication of said control pressure chamber with the atmosphere until said first sealing element has moved to said unsealed position thereof, thereby preventing said main valve from moving to said closed position thereof prior to said first sealing element moving to said unsealed position thereof.

2. A fastener driving device according to claim 1 wherein said first sealing element is a rubber O-ring constructed and arranged to seal said feed path when said actuating assembly is in said operative position; and said second sealing element is a rubber O-ring constructed and arranged to seal said exhaust port when said actuating assembly is in said inoperative position.

3. A faster driving device according to claim 1 wherein said actuating assembly is biased to said inoperative position thereof by a spring member.

4. A fastener driving device according to claim 1 wherein said biasing element is a coil spring.

5. A fastener driving device according to claim 1 wherein a spring structure biases said main valve to said closed position thereof.

6. A fastener driving device according to claim 1 wherein said biasing element is a coil spring mounted with respect to said actuating assembly; and said second sealing element is a rubber O-ring slidably mounted with respect to said actuating assembly and movable with respect to said actuating assembly.

7. A fastener driving device according to claim 1 wherein both said feed path and said exhaust port communicate with said control pressure chamber via a main passage.

8. A fastener driving device according to claim 1 wherein said exhaust seal structure is disposed within an interior portion of said main valve such that when said main valve moves to said opened position thereof, an inner peripheral surface of said main valve engages an annular valve element of said exhaust structure to prevent said one end of said cylinder from communicating with the atmosphere via said exhaust passage.

9. A fastener driving device according to claim 1 wherein said second sealing element is disposed on a washer and said biasing element is disposed between said washer and a seating surface defined on said actuating assembly.

10. A fastener driving device according to claim 1 wherein said second sealing element is biased against the biasing force of said biasing element by air pressure when said second sealing element is in said sealed position thereof.

11. A fastener driving device according to claim 1 wherein said actuating assembly includes an actuating member movably mounted with respect to said housing assembly, said first sealing element, said second sealing element, and said biasing element being mounted with respect to said actuating member, said actuating member being constructed and arranged to be disposed in an actuated position when said actuating assembly is in said operative position thereof and an unactuated position when said actuating assembly is in said inoperative position thereof, said first sealing element being in said sealed position thereof when said actuating member is in said actuated position and in said unsealed position thereof when said actuating member is in said unactuated position, said second sealing element being in said sealed position thereof when said actuating member is in said unactuated position and in said unsealed position thereof when said actuating member is in said actuated position.

12. A fastener driving device according to claim 11 further comprising a trigger assembly comprising:

a trigger housing mounted with respect to said housing assembly;

a trigger member pivotally connected to said trigger housing; and a rocker arm pivotally connected to said trigger member, said trigger housing, said trigger member, and said rocker arm being constructed and arranged such that manually engaging said trigger member causes said rocker arm to engage said actuating member and move said actuating member from said unactuated position thereof to said actuated position thereof, thereby moving said actuating assembly from said inoperative position thereof to said operative position thereof.

13. A fastener driving device according to claim 11 wherein said first sealing element is a rubber O-ring constructed and arranged to seal said feed path when said actuating assembly is in said operative position; and said second sealing element is a rubber O-ring constructed and arranged to seal said exhaust port when said actuating assembly is in said inoperative position.

14. A fastener driving device according to claim 11 wherein said actuating member is biased to said unactuated position thereof by a spring member, thereby biasing said actuating assembly to said inoperative position thereof.

15. A fastener driving device according to claim 11 wherein said biasing element is a coil spring.

16. A fastener driving device according to claim 11 wherein said biasing element is a coil spring mounted with respect to said actuating member; and said second sealing element is a rubber O-ring slidably mounted with respect to said actuating member and movable with respect to said actuating member.

17. A fastener driving device according to claim 11 wherein both said feed path and said exhaust port communicate with said control pressure chamber via a main passage.

18. A fastener driving device according to claim 11 wherein said second sealing element is disposed on a washer and said biasing element is disposed between said washer and a seating surface defined on said actuating member.

19. A fastener driving device according to claim 11 wherein said second sealing element is biased against the biasing force of said biasing element by air pressure when said second sealing element is in said sealed position thereof.

* * * * *